United States Patent [19]

Hawke

[11] Patent Number: 4,650,218

[45] Date of Patent: Mar. 17, 1987

[54] METHOD AND APPARATUS FOR CONTROLLING CALORIC INTAKE

[76] Inventor: Earle M. Hawke, 2917 E. Stratford Dr., Tucson, Ariz. 85716

[21] Appl. No.: 580,900

[22] Filed: Feb. 16, 1984

[51] Int. Cl.[4] ..... B42D 15/00

[52] U.S. Cl. ..... 283/67; 283/51; 283/1 A; 434/127

[58] Field of Search ..... 283/1 R, 1 A, 51, 67, 283/23; 434/127

[56] References Cited

U.S. PATENT DOCUMENTS

| | | | |
|---|---|---|---|
| 832,796 | 10/1906 | Kimber | 283/51 |
| 902,542 | 11/1908 | Albree | 283/51 |
| 997,356 | 7/1911 | Allen | 283/51 |
| 1,072,627 | 9/1913 | Lipps | 283/23 |
| 1,132,641 | 3/1915 | Wainwright et al. | 283/51 |
| 1,289,246 | 12/1918 | Palmer | 434/127 X |
| 1,325,477 | 12/1919 | Ketchum et al. | 283/51 |
| 1,368,467 | 2/1921 | Van Horn | 283/51 |
| 1,385,425 | 7/1921 | Bloomquist | 283/51 |
| 1,396,288 | 11/1921 | Roystone | 283/51 |
| 2,314,387 | 3/1943 | Carlsson | 434/127 |
| 2,337,405 | 12/1943 | Noel | 283/51 |
| 2,768,452 | 10/1956 | Littlejohn | 434/127 |
| 3,681,857 | 8/1972 | Yardley | 434/127 |
| 4,460,179 | 7/1984 | Hafer | 434/127 X |

OTHER PUBLICATIONS

Weight Watchers Program Handbook, Weight Watchers Int., published circa 1981 & Weekly Diary published circa 1981.

*Primary Examiner*—Paul A. Bell

*Attorney, Agent, or Firm*—H. Gordon Shields

[57] ABSTRACT

Method and apparatus for controlling caloric intake includes different types of foods segregated into food classifications, with predetermined helping sizes of each food given a predetermined caloric value for counting purposes. The selection of foods for a particular meal is considered in conjunction with the predetermined food count, and a daily food counter includes tabs representing the predetermined food counts which are discarded after the meal is consumed, and the food counts remaining indicate the various kinds and amounts of foods that may be eaten during the rest of the day and which then do not exceed the predetermined caloric intake.

14 Claims, 4 Drawing Figures

METHOD AND APPARATUS FOR CONTROLLING CALORIC INTAKE

BACKGROUND OF THE INVENTION

1. Field of the Invention

This invention relates to method and apparatus for controlling caloric intake, and, more particularly, to method and apparatus for controlling daily caloric intake by dividing foods into groups and determining caloric intake by equating caloric intake to food counts and using tear-off tabs to keep track of the caloric intake.

2. Description of the Prior Art

Diets of various kinds are, of course, well known and understood in the prior art. There are many kinds or types of diets, each claiming advantages over others or claiming specific advantages. The purpose of diets is to control caloric intake and to limit caloric intake to a predetermined maximum. Different kinds of diets provide not only different caloric intakes, but different types of foods for different purposes. For example, diabetics require one kind of diet, while a person suffering from obesity may require a different type of diet. A person having a particular physical ailment accordingly needs a diet or caloric intake, or both, which is directly related to the specific ailment. Some diets allow a person to eat almost any type of food, but simply control the quantity of food eaten. Other types of diets are designed to provide specific kinds of foods that may be eaten and to prevent other kinds of foods from being eaten.

For many diabetics, the control of calories is extremely important, but also important are the kinds of foods used to provide the desired calories. Thus, eating a well balanced diet is important, and limiting oneself to a predetermined number of calories from each of several food groups may be equally important.

Since a person typically eats three meals a day, breakfast, lunch, and supper, keeping track of the various food groups and calories involved may be difficult, particularly when one is not always in an environment where record keeping or prefixed meals are available. For example, a person typically eats breakfast and supper at home, but may eat lunch away from home, such as on the job. Restaurant eating either at lunch or supper provides an additional problem both in keeping track of calories and food groups.

The apparatus of the present invention provides a system of keeping track of caloric intake as divided into several food groups. This is accomplished by using lists of foods broken down into food groups and equating sized portions of food with specific caloric values equated as food units or counts. Tabs which may be torn from a card show the allowable food counts or units to be eaten from each food group during a day. A card may include a predetermined caloric intake, such as fifteen hundred calories, twelve hundred calories, eighteen hundred calories, etc., depending on the circumstances. For illustrative purposes herein, a fifteen hundred calorie intake is illustrated.

The use of tabs for various purposes is old in the art. For example, U.S. Pat. No. 1,072,627 discloses a streetcar ticket which includes a number of tabs. The tabs each represent a particular quantity or amount of money. The tabs may be torn off from the ticket as they are used to pay for streetcar rides.

U.S. Pat. No. 1,132,641 discloses a coupon book which contains a plurality of coupons. Each coupon represents a particular amount of money. The coupons are removed and are used as cash for merchandise or services.

U.S. Pat. No. 1,325,477 discloses a ticket sheet representing price tags. Each ticket may be torn off and used as money towards the purchase price of an article specified on the particular ticket. Each ticket is thus good for a certain amount of money towards the purchase of a particular, predetermined or predefined, product.

U.S. Pat. No. 1,385,425 discloses another type of ticket on which are printed different values representing money. The tickets or ticket portions may be torn off and used as money.

U.S. Pat. No. 1,396,288 discloses another type of ticket similar to that of the U.S. Pat. No. 1,385,425. The tickets indicate different amounts of money, and the ticket portions or tabs are removed to indicate the amount of money owed by a purchaser. That is, the ticket portions are not torn off and used as money, rather the remaining portions of the ticket represent the amount of money owed by a purchaser. The purchaser accordingly owes the lowest amount of money indicated on the remaining portion of the ticket.

U.S. Pat. No. 1,368,467 discloses a tally tablet for tabulating the amount of money deposited into a bank or the like. A number of tabs, corresponding to different denominations of money, are included in the apparatus. When a coin or a number of coins are deposited, tabs corresponding to the amount or value of the coins deposited are removed from the tally tablet to provide a record of the amount of money deposited.

U.S. Pat. No. 2,337,405 discloses a tearing guide designed for ration book stamps. The purpose of the guide apparatus is to help a user of ration books tear off stamps in a neat, orderly manner, without tearing adjacent stamps.

None of the above-described patents discloses apparatus comparable to the tabulating system of the present invention. However, they do reflect generally the concept that tabs or stamps may be torn off from a card, page, or the like, for purposes of record keeping.

SUMMARY OF THE INVENTION

The invention described and claimed herein comprises method and apparatus for controlling or tallying caloric intake by dividing food into food groups and by equating predetermined caloric quantities of food into food counts or food units. A diet regime is predetermined for a specific caloric intake per day by predetermining the caloric intake in terms of food units or food counts in each of the food groups on a daily basis. Record keeping for or tallying the caloric intake, or food counts or units is accomplished by means of a card having the daily number of food units or counts in each food group or category on the card in the form of tabs which may be torn off the card. As food is consumed in each food group, tabs corresponding to the quantity of food eaten, and thus the caloric value or food count or unit is recorded by simply tearing off the corresponding food count tabs. The tabs remaining on the card indicate to the user the caloric intake, in terms of each food group, which the person may eat during the rest of the day.

Among the objects of the present invention are the following:

To provide new and useful method and apparatus for providing caloric intake;

To provide new and useful apparatus for recording caloric intake;

To provide new and useful apparatus for indicating food groups which may be eaten by a person on a particular diet.

To provide a new and useful method for indicating how much food in food groups a person may consume during the course of a day;

To provide new and useful method and apparatus for predetermining caloric intake divided into categories of foods; and To provide guidance for a balanced diet.

DESCRIPTION OF THE PREFERRED EMBODIMENT

Figure 1:
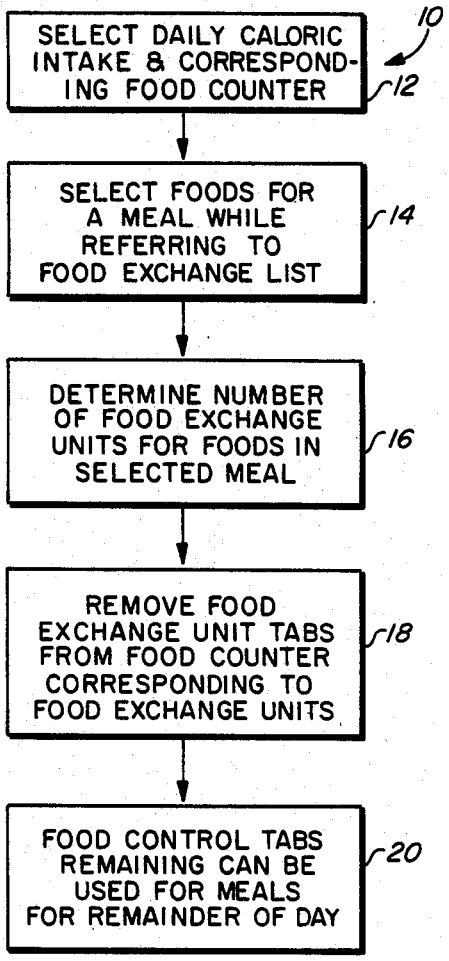
FIG. 1 is a block diagram giving sequentially the steps involved in the present invention.

FIG. 1 is a block diagram illustrating the steps used in implementing the present invention. For implementing the present invention, a food exchange list, such as shown in Table 1, is used.

FOOD EXCHANGE LIST TO BE USED WITH JEMEX FOOD COUNT (Copyrighted by JEMEX CO., 1983)

MEat exchanges
approx. 70 calories per exchange
Trim off all visible fat.

| | |
|---|---|
| beef, fish, ham, lamb, liver | 1 oz. |
| pork, poultry, veal | |
| clams, oysters, shrimp | 5 medium |
| cold cuts | 1 slice |
| crab, salmon, tuna | ½ cup |
| egg | 1 |
| hot dog (8–9 per lb.) count 1 FAt also | 1 |
| lobster (small tail) | 1 |
| sardines (drained) | 3 medium |
| sausage links count 1 FAt also | 2 |
| Vienna sausages | 2 |
| CHEESE: | |
| brick, cheddar, Swiss & processed count 1 FAt also | 1 oz. |
| cottage (low fat) | ½ cup |
| peanut butter count 2 FAt also | 2 Tbsp. |
| tofu | 3 oz. |

***

VEgetable exchanges
approx. 25 calories per exchange
Good source of vitamins, fiber. Eat raw and fresh, when possible.
One exchange equals 1 cup raw or ½ cup cooked. See exceptions, below.

| | |
|---|---|
| alfalfa sprouts | greens |
| artichoke | mushrooms |
| asparagus | okra |
| beets | onions |
| broccoli | rhubarb |
| Brussels sprouts | sauerkraut |
| cabbage | spinach |
| carrots | string beans, green or yellow |
| cauliflower | summer squash |
| celery | turnips |
| eggplant | zucchini |
| green pepper | |

-continued

FOOD EXCHANGE LIST TO BE USED WITH JEMEX FOOD COUNT (Copyrighted by JEMEX CO., 1983)

| | |
|---|---|
| EXCEPTIONS: | |
| bean sprouts | ½ cup |
| jicama | ½ cup |
| tomato | 1 medium |
| tomatoes, cherry | 5–6 |
| tomato catsup | 2 Tbsp. |
| vegetable juices | ½ cup |
| water chestnuts | 4 |

***

FRuit exchanges
approx. 40 calories per exchange
Fresh, whole fruit is preferable to juice.

| | |
|---|---|
| FRESH | |
| apple | 1 small |
| appricots | 2 |
| banana | ½ small |
| berries: black, blue, rasp. | ½ cup |
| cherries | 10 |
| dates | 2 |
| fig | 1 large |
| grapefruit | ½ |
| grapes | 14 |
| mango | ½ small |
| melon: | |
| cantaloupe 6" dia. | ½ |
| casaba | 1 cup |
| honeydew 7" dia. | ⅛ |
| watermelon | 1 cup |
| nectarine | 1 small |
| orange | 1 small |
| papaya | ⅓ medium. |
| peach | 1 medium |
| pear | 1 small |
| persimmon | 1 medium |
| plums | 2 |
| strawberries | ¾ cup |
| tangerine | 1 large |
| DRIED: | |
| apricots | 4 halves |
| figs | 1 small |
| prunes | 2 |
| raisins | 2 Tbsp. |
| JUICE: | |
| apple | ⅓ cup |
| cranapple (lo-cal) Not for diabetics. | 1 cup |
| cranberry (lo-cal) Not for diabetics. | ¾ cup |
| grape | ½ cup |
| grapefruit | ½ cup |
| nectars Not for diabetics. | ⅓ cup |
| orange | ½ cup |
| pineapple | ⅓ cup |
| prune | ½ cup |
| CANNED: | |
| In juice, no sugar, see "FRESH" above. | |
| applesauce, unsweetened | ½ cup |
| fruit coctail, juice-pak | ½ cup |
| pineapple, juice-pak chunks | ½ cup |
| crushed | ⅓ cup |
| slices | 2 |

***

BRead exchanges
approx. 68 calories per exchange
Cereals, starchy vegetables and more surprises are included in BRead list

| | |
|---|---|
| bagel | ½ |
| BREAD: | |
| white, whole wheat rye, raisin, pumpernickel, French, Italian | 1 slice |
| biscuit, 2" dia. count 1 FAt also | 1 |
| bun, hamburger/hot dog | ½ |
| cornbread | 1½" cube |
| dressing count 1 FAt also | 1 |

-continued

FOOD EXCHANGE LIST TO BE USED WITH JEMEX FOOD COUNT (Copyrighted by JEMEX CO., 1983)

| | |
|---|---|
| English muffin | ½ |
| muffin, 2" dia. count 1 FAt also | 1 |
| pancake, 6" dia. count 1 FAt also | 1 |
| pita | ½ |
| taco shell | 1 |
| tortilla, 6" dia. | 1 |
| waffle, 5" × 5" count 1 FAt also | 1 square |
| wheat germ | ½ cup |
| CEREALS: | |
| flakes | ¾ cup |
| puffed | 1 cup |
| cooked, hot | ½ cup |
| grits, pasta, rice (cooked) | ½ cup |
| CRACKERS: | |
| graham | 2 squares |
| matzo | ½ |
| melba toast | 4 |
| oyster | 20 |
| pretzels, 3" sticks | 25 |
| Ritz count 1 FAt also | 4 |
| Rykrisp | 3 |
| saltine | 5 |
| Triscuit count 1 FAt also | 5 |
| chips: corn, potato count 2 FAt also | 15 |
| STARCHY VEGETABLES: | |
| beans, peas, lentils (dried & cooked) | ½ cup |
| beans, baked | ½ cup |
| beans, lima | ½ cup |
| beans, refried count 1 FAt also | ½ cup |
| corn, creamed | ½ cup |
| corn, whole kernel | ⅓ cup |
| corn on cob | 1 small |
| hominy | ½ cup |
| parsnips | ⅔ cup |
| peas, green | ½ cup |
| popcorn, air popped, no butter | 3 cups |
| potatoes: | |
| baked, boiled | 1 small |
| french fries count 1 FAt also | 8 |
| mashed | ½ cup |
| sweet, yams | ½ cup |
| squash, winter | ½ cup |
| SOUPS: | |
| broth based | 1 cup |
| cream based count 1 FAt also | 1 cup |
| bean, pea, lentil | ½ cup |

***

FAt exchanges approx. 45 calories per exchange

| | |
|---|---|
| avacado, 4" dia. | ⅓ |
| bacon, crisp | 1 slice |
| butter, margarine | 1 tsp. |
| margarine, diet | 2 tsp. |
| cream, light | 2 Tbsp. |
| cream, sour | 2 Tbsp. |
| cream cheese | 1 Tbsp. |
| DRESSINGS: | |
| bleu cheese, 1000 island | 2 tsp. |
| French | 1 Tbsp. |
| Italian | 2 tsp. |
| mayonnaise | 1 tsp. |
| mayonnaise, imitation | 1 Tbsp. |
| oil (vinegar is "free") | 1 tsp. |
| tartar sauce | 1 tsp. |
| NUTS: | |
| almonds | 10 whole |
| coconut | 2 Tbsp. |
| pecans | 2 large |
| peanuts, Spanish | 20 |
| peanuts, Virginia | 10 |
| Brazil | 2 |
| pistachio | 20 |
| walnuts | 6 small |
| olives | 5 small |
| sunflower seeds | 1 Tbsp. |

***

MIlk exchanges

-continued

FOOD EXCHANGE LIST TO BE USED WITH JEMEX FOOD COUNT (Copyrighted by JEMEX CO., 1983)

approx. 80 calories per exchange

| | |
|---|---|
| skim or nonfat | 1 cup |
| whole count 2 FAt also | 1 cup |
| buttermilk | 1 cup |
| yogurt: nonfat, plain | 1 cup |
| yogurt: lowfat count 1 FAt also | 1 cup |
| evaporated count 2 FAt also | ½ cup |

FREE FOODS - NEGLIGIBLE CALORIES

| | |
|---|---|
| boullion | herbs |
| broth | horseradish |
| celery | lettuce, all varieties |
| chicory | lemons, limes |
| Chinese cabbage | mustard |
| chives | no-cal sweeteners |
| club soda | parsley |
| coffee | pepper |
| consumme | pickles: sour, dill |
| cucumber | radishes |
| diet soft drinks | romaine |
| endive | spices |
| escarole | spinach, raw |
| flavorings | tea |
| gelatin: | vinegar |
| unsweetened | watercress |
| dietetic, flavored | — |

In the food exchange list, food is divided into six categories, namely meat, bread, vegetables, fruit, fats, and milk. The food exchange list has food broken down into the six categories, with quantitative portions of food in each category defining a predetermined number of calories. For example, a one ounce portion of beef, fish, ham, etc., with all visible fat trimmed off, provides about seventy calories. Five medium sized clams, oysters, or shrimp, also provide about seventy calories. For bread, one-half of a bagel provides about sixty-eight calories. A two-inch diameter biscuit provides sixty-eight calories in the bread category, but also provides forty-five calories of fat. It will be noted that several of the bread items count in both bread and fat categories.

For vegetables, one cup of raw, or one-half cup cooked, of such items as alfalfa sprouts, beets, cabbage, carrots, spinach, and the like, will provide about twenty-five calories. One medium-sized tomato also provides about twenty-five calories, and about one-half cup of vegetable juices provides about twenty-five calories.

For fruit, one small apple provides about forty calories, as do two apricots, one one-half of a small banana. One-half grapefruit similarly provides about forty calories.

For fats, one slice of crisp bacon provides about forty-five calories of fat. Two teaspoons of diet margarine provide about forty-five calories, and one teaspoon of butter or margarine provides about forty-five calories. Ten whole almonds or two tablespoons of coconut similarly provide about forty-five calories.

In the milk category, one cup of skim or not-fat milk provides about eighty calories. One cup of buttermilk also provides about eighty calories. One cup of whole milk provides about eighty calories, but it also provides about ninety calories of fat. It will be noted that several listed items in the milk category provide both milk and fat calories.

In addition to the six categories of food, there are also listed a number of "free foods" whose calories are negligible.

For counting calories, a single food exchange unit is predetermined or defined to include the number of calories listed in the exchange list under each of the various food categories. It will be noted that one food exchange unit does not provide the same caloric intake in all categories. Rather, the calories differ from category to category. Thus, one food exchange unit for meat provides about seventy calories, but one food exchange unit for vegetables provides only about twenty-five calories. A single fruit exchange unit provides about forty calories, a single bread exchange unit provides about sixty-eight calories, a single fat exchange unit provides about forty-five calories, and a single milk exchange unit provides about eighty calories.

It has been determined that a well balanced, nutritious diet providing about fifteen hundred calories per day includes seven meat exchange units, six bread exchange units, four vegetable exchange units, four fruit exchange units, four fat exchange units, and two milk exchange units.

To change a fifteen hundred calorie per day diet to a nutritionally balanced twelve hundred calorie per day diet, there would be one less meat exchange unit, two less bread exchange units, and two less fat exchange units.

For illustrative purposes herein, a fifteen hundred calorie daily diet will be discussed, and is illustrated in the drawing.

Figure 2:
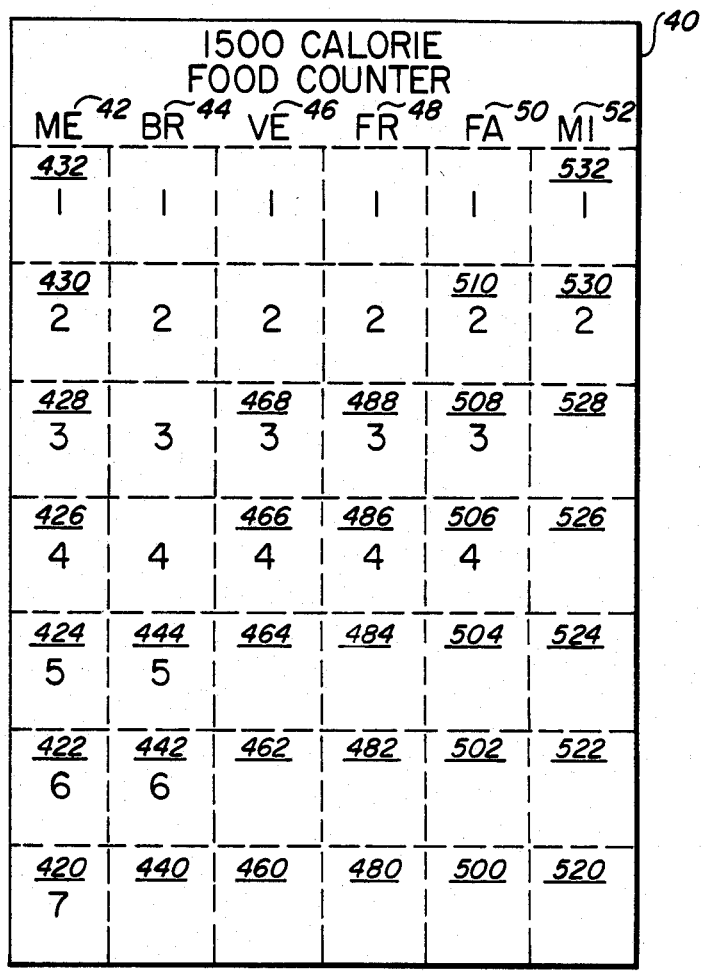
FIG. 2 is a schematic representation of a card comprising a part of the apparatus of the present invention.

FIG. 2 is a plan view of a food counter card 40 for a fifteen hundred calorie per day diet. The food counter card includes a plurality of tabs, some numbered to represent food exchange units and some blank. The blank tabs are simply for convenience. The food counter 40 is preferably made of cardboard or the like and is appropriately scored or perforated so that individual tabs may be easily torn away.

The food counter card 40 is identified as a fifteen hundred calorie food counter. The food counter 40 is divided into six columns or categories, a column or category 42 for MEat (meat), a column or category 44 for BRead (bread), a column or category 46 for VEgetables (vegetables), a column or category 48 for FRuit (fruit), a column or category 50 for FAt (fat), and a column or category 52 for MIlk (milk). In turn, each column or category is divided into a plurality of tabs, with each tab representing, quantitatively, a single food exchange unit.

As indicated above, seven meat food exchange units are allowed or are provided for in a fifteen hundred calorie per day diet. Seven is the highest number of food exchange units in any category for a fifteen hundred calorie diet. Accordingly, there are a maximum of seven tabs in each column. In column 42, the meat column, there are seven food exchange unit tabs, including a food exchange unit tab 420, a tab 422, a tab 424, a tab 426, a tab 428, a tab 430, and a tab 432. The tab 420 is identified by number 7, tab 422 is identified by number 6, tab 424 has the number 5 on it, tab 426 has the number 4 on it, tab 428 has the number 3 on it, tab 430 has the number 2 on it, and tab 432 has the number 1 on it.

It will be noted that the numbers are in descending order from the bottom to the top of each column. Thus in column 42, the number 7 tab 420 will be the first tab removed or torn from the food counter 40 when a single helping or portion of meat is consumed in a meal and which quantitatively equals the definition of a single food exchange unit for meat products. Tab 422, with the number 6 on it, then indicates to the user of the card 40 that there are six food exchange units remaining in the meat category that may be consumed during the balance of the day.

If during a single meal, a user eats meat that quantitatively adds up to three food exchange units, then three tabs would be removed from the card. If, for example, a user eats two eggs for breakfast, and has two sausage links, in accordance with the food exchange list, three food exchange units of meat, quantitatively, will be consumed. Accordingly, three food exchange unit tabs, namely tab 420 (the number 7 tab), tab 422 (the number 6 tab), and the tab 424 (the number 5 tab) will be torn or removed from column 42 of the food counter 40. The user then has a total of four food exchange units for meat that may be consumed during the rest of the day, as indicated by the remaining tabs 426, 428, 430, and 432.

In addition to the three meat food exchange units that must be torn from the card 40, it will be noted that two sausage links also count for one fat food exchange unit. Accordingly, a food exchange unit tab must also be removed from the card in the fat column 50.

In the fat food category column 50, the card 40 indicates that there are only four food exchange units allowed per day for a fifteen hundred calorie diet. Since there are a total of seven tabs in each column, the three bottom tabs in column 50 are blank. The blank bottom tabs in column 50 are indicated by reference numerals 500, 502, and 504. These tabs may be torn off and discarded immediately. The four other tabs in the fat column 50 include tab 506, with a 4 thereon, the tab 508 with a 3 thereon, a tab 510 with a 2 thereon, and a tab with a 1 thereon. The tab 506, the number 4 tab, as previously indicated, will be removed from column 50 along with tabs 420, 422, and 424, the meat category tabs from column 42.

As discussed above, the card 40 includes a number of blank tabs which may be discarded immediately upon beginning the use of the food counter card. The meat column 42, with seven numbered tabs, is the only column that is full. In the bread column 44, with only six food exchange unit tabs, there is a blank tab 440 at the bottom. A tab 442, with a 6 on it, is a first usable tab in column 44. Then, tabs with 4, 3, 2, and 1 on them complete the bread column.

In the vegetable column 46, there are four food exchange unit tabs with numbers, and accordingly there are three blank tabs at the bottom of the column. The blank tabs include a tab 460, a tab 462, and a tab 464. Tabs 466 and 468 include the number 4 and 3 on them, respectively. Tabs with the numbers 2 and 1 on them complete column 46.

The fruit column 48, and the fat column 50, are substantially identical to the vegetable column 46 in that they each include four food exchange unit tabs. In column 48, the three blank tabs include a tab 480, a tab 482, and a tab 484. Tabs 486 and 488 have numbers 4 and 3 on them, respectively. The final two tabs in column 46 include the numbers 2 and 1.

Column 50 has been discussed above, with its blank tabs 500, 502, and 504, and its numbered tabs, including tabs 506, 508, and 510, with 4, 3, and 2, on them, respectively. A tab with 1 on it completes the column.

Since only two food exchange units are allowed in the milk category per day with a fifteen hundred calorie daily diet, milk column 52 includes five blank tabs, including a tab 520, a tab 522, a tab 524, a tab 526, and a tab 528. The two usable food exchange tabs in column 52 include tabs 530 and 532, with a 2 and 1 on them, respectively.

The basic steps for implementing the present invention, including the use of the food counter 40, are illustrated in the block diagram of FIG. 1. The first step, as illustrated in a block 10, is to select a daily caloric intake and a corresponding food counter. The user then selects the foods for a meal. While selecting foods for the meal, a food exchange list, such as attached hereto as Exhibit A, is referred to for determining quantities and the caloric intake in the food selected. This is indicated in a block 14 of FIG. 1.

A block 16 indicates that the next step is to determine the number of food exchange units for the foods in the selected meal. After this has been accomplished, the food counter card 40 is utilized as the next step, shown in a block 18. The food exchange unit tabs are appropriately removed from the food counter 40. The tabs that are removed from the food counter correspond to the food exchange unit determined in the previous steps, shown in block 16.

Finally, as indicated in a block 20, the remaining food exchange unit tabs indicate what quantity of which food categories may be used for meals for the remainder of the day.

For the next meal of the day, the last four steps, in blocks 14, 16, 18, and 20, are then repeated. The final step, block 20, carries over and shows what may be utilized for the remainder of the day.

Figure 3:
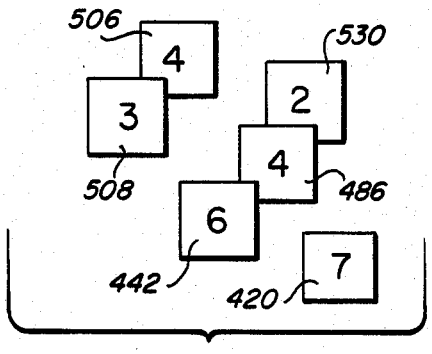
FIG. 3 is a schematic representation illustrating tabs torn off the card of FIG. 2.
Figure 4:
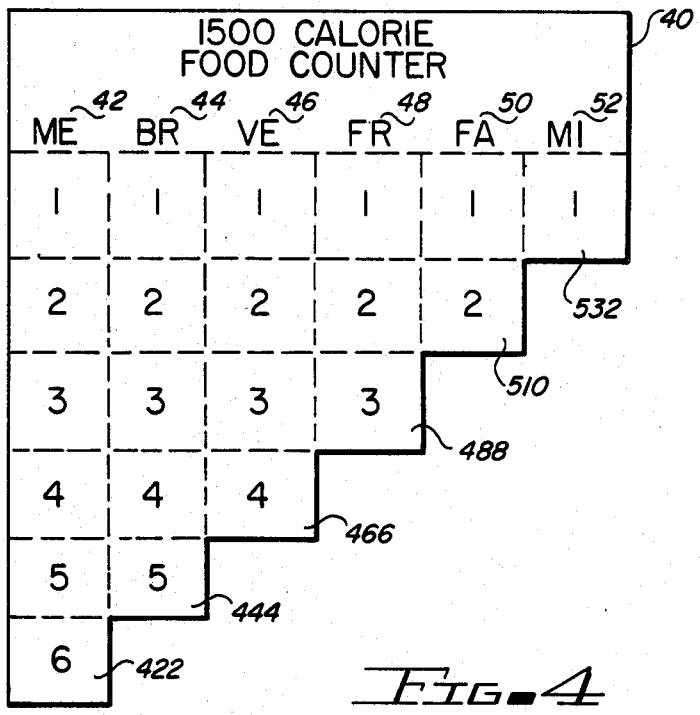
FIG. 4 is a schematic representation of the apparatus of FIG. 2 after tabs shown in FIG. 3 have been removed.

FIGS. 3 and 4 illustrate the implementation of the process discussed above in selecting a meal with a predetermined fifteen hundred caloric intake for the day. FIG. 3 illustrates the removal of six food exchange unit tabs from the card 40. FIG. 4 shows the card 40 after the removal of the six food exchange unit tabs shown in FIG. 3, plus the removal of the blank tabs from the card. A quick tally or tabulation of the tabs remaining indicates that 6 meat row exchanges, 5 bread exchanges, 4 vegetable exchanges, 3 fruit exchanges, 2 fat exchanges, and 1 milk exchange are available for the rest of the day.

As a first step, a user selects fifteen hundred calories for daily intake. This is the first step shown in block 12. For the second step, shown in block 14, the user selects the food for a meal while referring to a food exchange list, such as attached hereto as Exhibit A. For example, a breakfast may be selected which includes an egg, toast with butter, grapefruit, bacon, and skim milk. Referring to the food exchange list and looking up the selected foods, the user determines that one egg is the equivalent of one meat food exchange unit. One piece of toast with one teaspoon of butter is the equivalent of one bread food exchange unit and one fat food exchange unit. One-half grapefruit is the equivalent of one fruit food exchange unit. One piece of bacon is the equivalent of one fat food exchange unit, and one cup of skim milk is the equivalent of one milk food exchange unit. This process comprises the next step, shown as block 16.

The user then continues to the next step, shown as block 18, which is to remove the appropriate food exchange unit tabs from the food counter card 40 which correspond to the food exchange units determined from the previous step.

After tearing off and discarding the blank tabs from the card 40, the tab 420, the number 7 tab in meat exchange column 42, is torn off. Then, going to column 44, the bread category column, food exchange tab 442 is then removed.

Since no food in the vegetable category has been selected for breakfast, no vegetable food exchange tabs from column 46 are removed. One food exchange tab, tab 486, from the fruit category column 48, is removed.

Two fat exchange unit tabs are removed since both butter and bacon have been selected for the meal. Tabs 506 and 508, the numbers 4 and 3 tabs, respectively, are removed from the fat column 50. Finally, food exchange tab 530, one of the two milk food tabs, is removed from the card 40.

Thus, six food exchange tabs are removed from the card 40. The six tabs represent the food exchange unit equivalents in the selected meal. The food counter card 40 now has the food tabs remaining thereon that may be used for meals for the rest of the day.

The card 40 in FIG. 4 shows six meat category food exchange units remaining, beginning with the number 6 tab 422. Five bread food exchange units, beginning with the number 5 tab 444, also remain. The full daily complement of four vegetable food exchange units from the vegetable category 46, beginning with the tab 466, also remain.

In the fruit category, column 48, there remain three food exchange unit tabs, beginning with the number 3 tab 488. In the fat category, only two food exchange unit tabs remain, beginning with the number 2 tab 510. Finally, in the milk category column 52, there remains only one milk exchange unit tab, the number 1 tab 532.

By carefully selecting the foods from the food exchange list in the quantities commensurate with the food exchange units and by following the procedure outlined herein, with the use of the card 40 and its various tabs, a nutritionally balanced diet and a limited caloric intake will be provided for each user. By removing the food exchange unit tabs with each meal, the user automatically keeps track of not only the caloric intake, but also the remaining foods in each of the categories that are available for future consumption during the rest of the day are clearly set forth. Thus, diabetic, obese, or other people who, for various reasons may wish to control their caloric intake while maintaining a balanced diet, have available a procedure and apparatus to do so.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. A method for controlling daily caloric intake, comprising, in combination, the steps of:

providing a food exchange list which indicates food quantities in terms of calories and food exchange units;

selecting a daily caloric intake;

providing a food counter corresponding to the selected caloric intake and having a plurality of removable tabs representing caloric intake in terms of food exchange units;

selecting foods for a meal;

comparing the selected foods with the food exchange list; and determining the number of food exchange units in the foods selected for the meal.

2. The method of claim 1 which further includes the step of removing from the food counter tabs representing food exchange units corresponding to the number of food exchange units in the food of the selected meal.

3. The method of claim 2 which further includes the step of determining the number of food exchange units remaining for meals for the remainder of the day by counting the remaining tabs.

4. The method of claim 1 in which the step of providing a food exchange list further includes the step of categorizing foods into a plurality of categories.

5. The method of claim 4 in which the step of providing a food counter further includes the step of providing tabs representative of food exchange units in the plurality of categories for providing a balanced diet.

6. The method of claim 5 which further includes the step of removing tabs from the food counter corresponding to the quantity and in the categories, of food selected for the meal.

7. Apparatus for controlling daily caloric intake, including, in combination:

food exchange list means including a plurality of foods listed by quantitative amounts corresponding to a predetermined quantity of calories and with the predetermined quantity of calories comprising a food exchange unit; and food counter means having a plurality of tabs representing food exchange units corresponding to the food exchange units in the food exchange list for determfining caloric intake.

8. The apparatus of claim 7 in which the food exchange list means further includes a plurality of categories into which the plurality of foods are placed and from which meals may be selected for providing a balanced diet.

9. The apparatus of claim 8 in which the food counter means further includes a plurality of categories corresponding to the categories of the food exchange list means.

10. The apparatus of claim 9 in which the tabs of the food counter means are included in the plurality of categories in accordance with predetermined standards for a balanced diet and caloric intake.

11. The apparatus of claim 10 in which each tab represents a food exchange unit, and the tabs are adapted to be removed from the food counter means when the quantity of food represented by a food exchange unit is consumed, thereby indicating by the remaining tabs the kind of food and the quantity of food which may be eaten to provide a balanced diet and the predetermined caloric intake for the remainder of the day.

12. The apparatus of claim 11 in which the food counter means includes a card, and the plurality of tabs comprises a number of tabs for providing the predetermined caloric intake for a single day.

13. The apparatus of claim 12 in which the food counter means further includes a plurality of cards representing a predetermined time period, with one card representing the number of food exchange units for a single day.

14. The apparatus of claim 13 in which each card is identified to represent a specific day of the week.

* * * * *